US009308757B2

(12) United States Patent
Lutz

(10) Patent No.: US 9,308,757 B2
(45) Date of Patent: Apr. 12, 2016

(54) PRINT HEAD ADJUSTMENT DEVICE

(75) Inventor: Patrik Lutz, Markt Erlbach (DE)

(73) Assignee: PadaLuma Ink-Jet-Solutions GmbH & Co. KG, Markt Erlbach (DE)

( * ) Notice: Subject to any disclaimer, the term of this patent is extended or adjusted under 35 U.S.C. 154(b) by 0 days.

(21) Appl. No.: 14/414,470

(22) PCT Filed: Jul. 16, 2012

(86) PCT No.: PCT/EP2012/002982

§ 371 (c)(1),
(2), (4) Date: Feb. 12, 2015

(87) PCT Pub. No.: WO2014/012560

PCT Pub. Date: Jan. 23, 2014

(65) Prior Publication Data

US 2015/0165799 A1 Jun. 18, 2015

(51) Int. Cl.

| | |
|---|---|
| ***B41J 25/308*** | (2006.01) |
| ***B41J 2/155*** | (2006.01) |
| ***B41J 25/00*** | (2006.01) |
| ***B41J 25/34*** | (2006.01) |

(52) U.S. Cl.

CPC ..... *B41J 25/308* (2013.01); *B41J 2/155* (2013.01); *B41J 25/001* (2013.01); *B41J 25/34* (2013.01); *B41J 2202/19* (2013.01); *B41J 2202/20* (2013.01)

(58) Field of Classification Search

CPC ..... B41J 25/34; B41J 2202/19; B41J 25/001; H02K 7/08

See application file for complete search history.

(56) References Cited

U.S. PATENT DOCUMENTS

| | | | | |
|---|---|---|---|---|
| 5,450,119 | A * | 9/1995 | Hinton et al. | 347/242 |
| 2002/0024554 | A1 | 2/2002 | Tominaga | |
| 2005/0140730 | A1* | 6/2005 | Silverbrook | 347/49 |
| 2010/0133925 | A1* | 6/2010 | Finkbeiner et al. | 310/12.31 |
| 2010/0245415 | A1* | 9/2010 | Tsai et al. | 347/8 |
| 2011/0074877 | A1 | 3/2011 | Shinoda | |
| 2012/0147094 | A1 | 6/2012 | Hagiwara et al. | |

FOREIGN PATENT DOCUMENTS

| | | | |
|---|---|---|---|
| EP | 2353868 | A1 | 8/2011 |
| WO | WO2005108094 | A1 | 11/2005 |

(Continued)

OTHER PUBLICATIONS

International Preliminary Report on Patentability; Dated Jan. 29, 2015 for the corresponding PCT Application No. PCT/EP2012/002982.

(Continued)

*Primary Examiner* — Stephen Meier
*Assistant Examiner* — John P Zimmermann
(74) *Attorney, Agent, or Firm* — Mendelsohn Dunleavy, P.C.; Steve Mendelsohn

(57) ABSTRACT

Disclosed is a print head adjustment device (1) for an inkjet printer. The print head adjustment device includes an adjustment adapter (4) and a print head (3) that has a printing side (6) extending on an X-Y plane. The adjustment adapter (4) includes a receiver (20) which is adjustable in the X-Y plane and in which a stationary end (9) of the print head (3) is accommodated. A movable end (8) of the print head (3) is mounted on the adjustment adapter (4) so as to be slidable in the X direction and rotatable about an axis of rotation that is perpendicular to the X-Y plane.

20 Claims, 4 Drawing Sheets

(56) References Cited

FOREIGN PATENT DOCUMENTS

| | | | |
|---|---|---|---|
| WO | WO2011002747 | A2 | 1/2011 |
| WO | WO2014012560 | A1 | 1/2014 |

OTHER PUBLICATIONS

Chinese Office Action; Mailed Nov. 24, 2015 for CN Application No. CN201280074725.4.

* cited by examiner

PRINT HEAD ADJUSTMENT DEVICE

FIELD

The invention relates to a print head adjustment device for an inkjet printer. Here, the invention is concerned, in particular, with the problem of influencing the print quality of a single-pass inkjet printer during thermal cycling of the fastening means of the print heads in the print head modules.

BACKGROUND

Whereas, in a conventional inkjet printer, the print heads which are mounted on a carriage spray ink droplets line by line in the transverse direction (also called X-direction) onto the medium which is transported discontinuously in the running direction (also called Y-direction), in a single-pass inkjet printer the print heads are mounted in print head modules in the transverse direction over the entire width of the medium. The printing medium can be moved continuously in the running direction. Whereas printing speeds of up to 2 m/min are achieved in a conventional inkjet printer, printing speeds of up to 50 m/min can be achieved by way of a single-pass inkjet printer. For color printing, a plurality of print head modules are mounted one behind another in the running direction in a single-pass inkjet printer. Here, the print head modules are assigned in each case one primary color, in particular cyan, magenta and yellow, and possibly black. For special printing uses, further print head modules with a special color can be added.

A single-pass inkjet printer is suitable, in particular, for industrial use, in which bulk articles have to be printed and a high throughput is therefore important. A single-pass inkjet printer is likewise suitable for printing large-area objects on account of the high printing speeds. A single-pass inkjet printer is therefore suitable, in particular, for industrial applications of the furniture or ceramic industry, where floor coverings, such as laminates or ceramic tiles, worktops, moldings or the like are to be provided with a decorative pattern. Here, a very wide variety of inks are used which are, for example, resistant with respect to a later protective covering, etc.

In comparison with conventional printing processes, such as gravure printing or the like, the single-pass inkjet printer is used precisely even in the case of small batch sizes, where the production of an impression roll is not worthwhile. In contrast, a single-pass inkjet printer also makes individualization of the decorative patterns possible, and what are known as impossible decorative patterns which cannot be achieved by way of rolls. The single-pass inkjet printer is not restricted to a continuous repetition of a printing pattern or repeating pattern, as is the case in rotary printing.

An individual print head module for a single-pass inkjet printer can certainly achieve dimensions in the transverse direction and vertically (also called Z-direction) of more than half a meter up to over a meter. The print heads which are combined in the printing bars of a print head module can in each case have widths of up to several tens of centimeters. Here, resolutions of up to 600×600 dpi (dots per inch) are possible. Here, several thousand nozzles are contained per print head. Printing widths of up to a few meters can be achieved by way of large print head modules or by way of a plurality of print head modules being arranged next to one another.

Positional deviations of a few micrometers can be detected in a printed image by way of the human eye. In the case of the abovementioned resolutions, the individual nozzles of a print head lie only a few tens of micrometers apart from one another. The size of an image dot itself is in the range of 10 micrometers. It becomes clear that, in the case of a single-pass inkjet printer having a plurality of print head modules which are arranged one behind another in the running direction, an adjustment of the print heads in the micrometer range becomes necessary, in order to produce a high quality printed image. The adjustment of a print head module in a single-pass inkjet printer is therefore very complicated. For example, the position of the print heads which are mounted in the print head module has to be detected by light microscopy and set manually in a complex manner to this end. The setting up of a single-pass inkjet printer is therefore comparatively protracted.

With respect to the construction of a single-pass inkjet printer which is simplified with regard to the adjustment of the print heads, WO 2005/108094 A1 proposes to hold the individual print heads in each case in a prestressed state in a frame of the print head module. Here, each print head is pressed in its corresponding cutout against the opposite frame edge by means of a mechanical spring element. A prestress of this type can be performed both in the X-direction and in the Y-direction.

Disadvantageously, the position of the print heads with respect to the respective print head module is fixed in an arrangement of this type on account of the prestressed stop. Production-induced tolerances of the print head or the frame dimensions cannot be corrected in this way. Relative positioning of the print heads with respect to the print head module is not made possible.

Secondly, it is described in WO 2005/108094 A1 to mount the print heads in a print head module such that they can be displaced longitudinally in the transverse direction (X-direction) and in the running direction (Y-direction) in order to compensate for production tolerances. The position of a print head with respect to the print head module can be set by way of corresponding displacement of the print head. The relative orientation of the print heads with respect to the print head module takes place by means of a suitable tool, before the print head module with the print heads which are then positioned exactly is inserted in a positionally fixed manner into the single-pass inkjet printer.

It has been shown disadvantageously that a print head which is installed in a positionally fixed manner with respect to the print head module is capable of changing its relative position with respect to the print head module in the case of thermal cycling. Surprisingly, permanent positional changes of the print head can occur here, which lead to visible deviations in the printed image.

SUMMARY

It is therefore an object of at least one embodiment of the invention to specify a print head adjustment device which firstly permits positioning of the print head with respect to a print head module but secondly is as insensitive as possible with respect to thermal cycling.

According to the embodiment, this object is achieved by way of a print head adjustment device for a print head with a printing side which extends in an X-Y plane, an adjustment adapter with a receiver, such as a receiving means, which can be adjusted in the X-Y plane being included. A fixed end of the print head is received in the adjustable receiving means. Furthermore, a loose end of the print head is mounted on the adjustment adapter such that it can be displaced in the X-direction and such that it can be rotated about a rotational axis which is perpendicular with respect to the X-Y plane.

Here, the embodiment proceeds in a first step from the finding obtained by observations of the applicant that a print head which is fixed in the print head module also changes its relative position to the print head permanently under thermal cycling because, after a temperature-related response during the return to the starting temperature, it is not ensured that the print head again assumes its original position. For example, in the case of a print head which is clamped in on two sides on the print head module, it is not stipulated during a temperature-induced thermal expansion which of the clamping sides assumes the role of the fixed end or the loose end. During cooling of the print head to the original temperature, the clamping sides can also in turn swap their roles as fixed end or as loose end. Under multiple thermal cycling, despite being clamped in on the print head module, a print head is therefore capable of migrating in the manner of a caterpillar movement in the micrometer range, which can result in visible deviations in the printed image of the single-pass inkjet printer. Tests by the applicant have resulted in actual positional changes in the range of a few micrometers in the case of clamped in print heads during the operation of a single-pass inkjet printer.

The positional shift of the print heads which is visible in the printed image and occurs during operation of a single-pass inkjet printer despite fixing of the print heads on the print head module is therefore a consequence of frequent temperature cycles. The frequent temperature cycles are an immediate consequence of the fact that the print head and its installation surroundings are subjected to continually different temperatures during operation as a result of the piezoelectric activity of the ink ejection nozzles firstly and as a result of the inflow of the ink secondly. Even the operation of an inkjet printer in a temperature-controlled space is therefore not capable of eliminating said problem.

In a second step, the embodiment proceeds from the consideration of admittedly fixing the print head in its relative position such that it can be positioned in the print head module, but in the process of which fixing the print head in such a way that there is a defined floating bearing, as a result of which the print head automatically repositions itself into the original position after a temperature-related response.

The latter takes place by virtue of the fact that the print head is received by an adjustment adapter. Here, a loose end of the print head is mounted on the adjustment adapter such that it can be displaced in the X-direction and such that it can be rotated about a rotational axis which is perpendicular with respect to the X-Y plane. A fixed end of the print head is received in a receiving means which can be adjusted on the adjustment adapter in the X-Y plane. The print head with the adjustment adapter, that is to say the print head adjustment device per se, is fastened to a print head module. To this end, the adjustment adapter can be screwed, adhesively bonded, pressed or connected in some other way on the print head module.

By way of an adjustment of the receiving means which receives the fixed end on the adjustment adapter, firstly the position of the print head with respect to the print head module can be changed in the transverse or X-direction and secondly the azimuth angle of the print head can be set in the X-Y plane with rotation about the rotational axis which is defined at the loose end. The loose end of the print head is additionally mounted such that it can be displaced in the X-direction. Despite being clamped in on two sides, migration of the print head after frequent thermal cycling is prevented as a result. A length difference of the print head with respect to the print head module which results as a consequence of a temperature-related response is absorbed by the loose end which can be displaced in the X-direction. After a temperature-related response, the displaceable loose end of the print head returns into its original position again. The print head has not changed its position with respect to the print head module.

By way of the adjustment adapter which is provided, the embodiment makes it possible to orient a print head with respect to a print head module and subsequently to fix it. As a result of the defined assignment of a loose end, migration of an oriented and fixed print head is secondly avoided during frequent thermal cycling.

The embodiment is suitable in principle for every inkjet printer. In particular, the embodiment is suitable for a single-pass inkjet printer, in which even positional changes of the print head in the micrometer range can have negative effects on the quality of the printed image.

The receiving means can be configured such that it can be adjusted or displaced on the adjustment adapter by means of a sliding bearing, plain bearing or anti-friction bearing or by means of a combination of different bearing types. A slotted guide, positive guide or the like can also be provided for changing the position of the receiving means on the adjustment adapter. Other means for adjustable fastening of the receiving means on the adjustment adapter can also be realized. In particular, a turning and sliding joint can in turn be configured for mounting the loose end of the print head. A linear guide which is for its part mounted rotatably can also be provided for the loose end.

In order to keep the temperature-related response of the print head adjustment device per se as low as possible, the adjustment adapter is preferably manufactured substantially from a stretch-free material which, in a temperature range between 20° C. and 50° C., in particular between 25° C. and 40° C., has a coefficient of thermal expansion of less than $5*10^{-6}K^{-1}$, in particular of less than $2*10^{-6}K^{-1}$. A material of this type is, for example, an Invar steel alloy, a CRP (carbon fiber reinforced plastic) material or a ceramic. On account of the comparatively complex machining of ceramic, however, a steel alloy or a CRP material is to be preferred.

The receiving means is preferably configured such that it can be adjusted independently in the X-direction and in the Y-direction. The fixed end of the print head can be positioned more accurately by way of an independent adjustability in the X-direction and in the Y-direction. In particular, the position of the print head is adjusted in the transverse direction of the single-pass inkjet printer by way of the adjustment in the X-direction. By way of an independent adjustment in the Y-direction, the pivoting of the print head about the rotational axis of the loose end takes place, as a result of which the parallelism of the print head with respect to the print head module is set.

In one preferred development of the print head adjustment device, the receiving means comprises two rotatable eccentric cams which are arranged offset in the X-Y plane and against which the fixed end of the print head bears. In a simple and mechanically stable construction, the position of the print head is set in the transverse direction by way of rotation of one of the eccentric cams. By way of rotation of the other eccentric cam, the print head is pivoted in the X-Y plane about the rotational axis of the loose end. The transverse position and rotary angle of the print head can be set independently of one another with a high resolution. By way of fixing of the set position of the eccentric cams, the fixed end of the print head is fixed on the adjustment adapter. The fixing can be configured, for example, by way of a self-locking gear mechanism in a drive of the eccentric cams or by way of mechanical or electric blocking means.

The fixed end of the print head can in principle be mounted fixedly on the receiving means without a degree of freedom. Since, however, pivoting of the print head about the rotational axis on the loose end is to remain possible, the fixed end of the print head is advantageously prestressed against the receiving means. By way of a prestress, the position of the fixed end in the X-Y plane can be maintained and at the same time the pivotability can remain ensured as one possible degree of freedom of the print head without a complicated mechanical construction. The prestress can be realized by way of suitable electromagnetic or mechanical prestressing means. In particular, spring elements such as leaf springs or helical springs are suitable as mechanical prestressing means.

In one expedient refinement, the fixed end of the print head is prestressed magnetically against the receiving means. In other words, in particular, permanent magnets are provided which exert a force on the fixed end in the direction of the receiving means. To this extent, the fixed end can either be attracted in the direction of the receiving means or can be repelled by the magnetic means. To this end, either the receiving means or the fixed end is magnetic.

In order to define the rotational axis of the loose end, the adjustment adapter preferably comprises a stop element, against which the loose end of the print head bears in the Y-direction. The rotational axis is fixed by way of the stop region, in which the loose end bears against the stop element. The stop element is expediently configured as a pin which extends in the Z-direction. Here, the pin axis per se at the same time forms the rotational axis of the loose end of the print head.

In order that the loose end bears against the stop element, the print head is preferably prestressed against the stop element. The prestress can once again be realized as mentioned by way of suitable electromagnetic or mechanical prestressing means. Spring elements such as leaf springs or helical springs are suitable as mechanical prestressing means. Magnetic means which exert a force on the loose end in the direction of the stop element are particularly preferred. Magnetic means of this type can attract the loose end in the direction of the stop element or can repel it. Permanent magnets are expediently used as magnetic means, either the stop element or the loose end of the print head being of magnetic configuration.

The adjustment adapter itself can be of single piece or multiple piece configuration. In particular, parts of the adjustment adapter can also be integrated on the print head module or on a corresponding installation frame of the print head which is situated there. In the latter case, the claimed print head adjustment device is possibly present only after mounting of the print head on the print head module has taken place.

In one advantageous refinement, the adjustment adapter is of multiple piece configuration. As a result, simple mounting of the print head adjustment device on the print head module can be achieved. In one variant which is preferred in this regard, the adjustment adapter is divided into a first adapter part which receives the loose end of the print head and into a second adapter part which receives the fixed end of the print head. For mounting purposes, for example, the first adapter part can first of all be fastened to the print head module. Subsequently, the print head module can be mounted with the second adapter part, the loose end being fed to the first adapter part which has already been mounted.

The adjustment adapter expediently comprises a contact face for the print head in the Z-direction. This ensures that the print head is held reliably in the print head module in the direction of the printing side. The contact face suppresses the print head falling out or moving in the Z-direction against the printing face.

The print head is once again preferably prestressed against the contact face of the adjustment adapter. The abovementioned means can expediently be used as prestressing means.

In a further advantageous refinement of the print head adjustment device, an electric drive for adjusting the adjustment adapter is provided. As a result, simple readjustment of the print heads during setting up of a single-pass inkjet printer is made possible. Secondly, continuous tracking of the print heads can also take place during operation of the single-pass inkjet printer by way of a running position check, if contrary to expectation a positional change of the print head has occurred during operation.

BRIEF DESCRIPTION OF THE DRAWINGS

Exemplary embodiments of the invention will be explained in greater detail using a drawing, in which.

DETAILED DESCRIPTION

Figure 1:
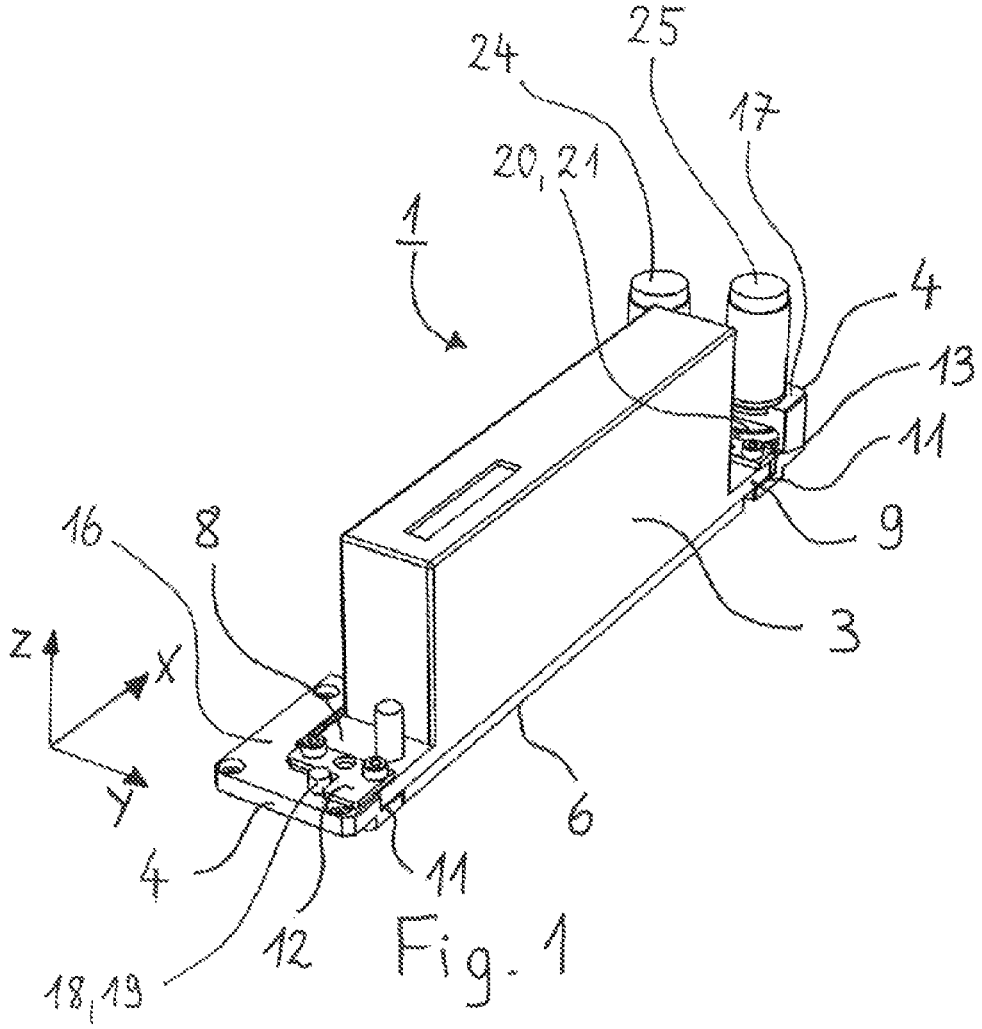
FIG. 1 shows a perspective illustration of a first variant of a print head adjustment device with a print head and an adjustment adapter.

The print head adjustment device 1 which is shown in FIG. 1 comprises a print head 3 which is mounted adjustably on an adjustment adapter 4. The assembly which is shown and comprises the adjustment adapter 4 and the print head 3 is installed into a frame of a print head module (not shown). Here, in particular, the adjustment adapter 4 is screwed to the frame of the print head module. An adjustment of the print head 1 with respect to the print head module is made possible by way of a positional change of the print head 1 with respect to the adjustment adapter 4.

The print head 3 which is shown in an assembly with the adjustment adapter 4 in a manner which corresponds to FIG. 1 extends substantially along the transverse direction (X-direction). During printing, the printing medium is moved through below the print head 3 in a running direction (Y-direction). On its underside which is not visible, the print head 3 has a printing side 6 which is formed as an array comprising individual ink ejection nozzles. During printing, ink droplets are ejected from the ink ejection nozzles in the Z-direction onto the printing medium which is running through. The actuation of the individual ink ejection nozzles takes place, in particular, in a piezoelectric manner. The position of the X-Y-Z coordinate system is also illustrated.

The assembly which is shown and comprises the print head 3 and the adjustment adapter 4 is part of a print head module in the mounted state. A print head module of this type extends in the transverse or X-direction over the entire width to be printed of the printing medium. A plurality of the print head adjustment devices 1 which are shown are arranged next to one another along the X-direction and offset with respect to one another in the Y-direction in the print head module.

The print head 3 is mounted with a loose end 8 and with a fixed end 9 on the adjustment adapter 4 such that it can be adjusted in the X-Y plane. In the Z-direction, the adjustment adapter 4 has contact faces 11, on which ends of the print head 3 which extend in the X-direction rest. In this way, the spacing of the printing side 6 of the print head 3 from the printing medium in the Z-direction is defined.

A first contact element 12 and a second contact element 13 are mounted at the two ends of the print head 3 which extend in the X-direction, that is to say at the loose end 8 and at the fixed end 9. The contact elements 12, 13 serve to position the print head 3 with respect to the adjustment adapter 4. As an alternative, the ends of the print head 3 per se can also be configured for positioning on the adjustment adapter 4 without mounted contact elements 12, 13. In the present case, the contact elements 12, 13 are screwed in each case to the ends of the print head 3.

In the print head adjustment device 1 according to FIG. 1, the adjustment adapter 4 is of two-piece configuration. It can likewise also be manufactured in one piece. The adjustment adapter 4 which is shown comprises a first adapter part 16 for fixing the loose end 8 of the print head 3 and a second adapter part 17 for fixing the fixed end 9 of the print head 3. Both adapter parts 16, 17 are of angular configuration and have fastening means (bores in the present case) for fastening to a frame of the print head module (not shown).

The first adapter part 16 comprises a pin 19 which extends in the Z-direction as a stop element 18 for the loose end 8 of the print head 3. The substantially L-shaped first contact element 12 at the loose end 8 of the print head 3 bears against the pin 19 in the Y-direction with its limb which extends in the X-direction. The loose end 8 is prestressed against said pin 19 by way of magnetic means which cannot be seen in FIG. 1. There is a play in the X-direction between the other limb of the first contact element 12 and the pin 19. The loose end 8 is therefore guided on the first adapter part 16 of the adjustment adapter 4 such that it can be displaced in the X-direction. The pin 19 represents a rotational axis for the loose end 8, which rotational axis extends in the Z-direction.

The second adapter part 17 of the adjustment adapter 4 comprises a receiving means 20 which can be adjusted in the X-Y plane and in which the fixed end 9 of the print head 1 is received. In particular, the fixed end 9 of the print head 1 is prestressed against the receiving means 20 in the X-direction and in the Y-direction by means of magnetic means which once again cannot be seen in FIG. 1. The receiving means 20 comprises a first visible eccentric cam 21 and a second eccentric cam 22 which is arranged offset with respect thereto in the X-Y plane and is not visible (to this end, see FIG. 2). By way of driving of the two eccentric cams 21, 22, the fixed end 9 of the print head 1 is moved and fixed independently in the X-direction (first eccentric cam 21) and in the Y-direction (second eccentric cam 22). Electric drives 25 and 24 are provided for actuating the eccentric cams 21, 22.

It already becomes clear from FIG. 1 that the loose end 8 of the print head 3 is fixed in the Y-direction on the first adapter part 16 of the adjustment adapter 4, but is mounted such that it can be pivoted about a rotational axis which is defined by the pin 19. The loose end 8 of the print head 1 is of displaceable configuration in the X-direction. The first contact element 12 and the pin 19 to this extent form a turning and sliding joint for the loose end 8 of the print head 1. The fixed end 9 of the print head 3 can be displaced in the X-Y plane by way of actuation of the two eccentric cams 21, 22. Here, the position of the fixed end 9 in the X-Y plane is fixed by the stop of the second contact element 13 on the two eccentric cams 21, 22. The print head 3 overall is displaced in the X-direction via an actuation of the first eccentric cam 21. By way of actuation of the second eccentric cam 22, the print head is rotated in the X-Y plane about the rotational axis which is defined by the pin 19, and therefore the azimuth angle of the print head 3 in the X-Y plane is set.

If a length change of the print head 3 between the loose end 8 and the fixed end 9 occurs during thermal cycling, the loose end 8 is displaced in the X-direction with respect to the pin 19. If the original temperature is reached again after a temperature-related response, the loose end 8 of the print head 1 also returns into its original position. Migration of the print head 1 with respect to the print head module as a consequence of multiple thermal cycling is prevented by way of the present adjustment adapter 4. At the same time, the print head can be adjusted and positioned with respect to the print head module by way of actuation of the receiving means 20.

Figure 2:
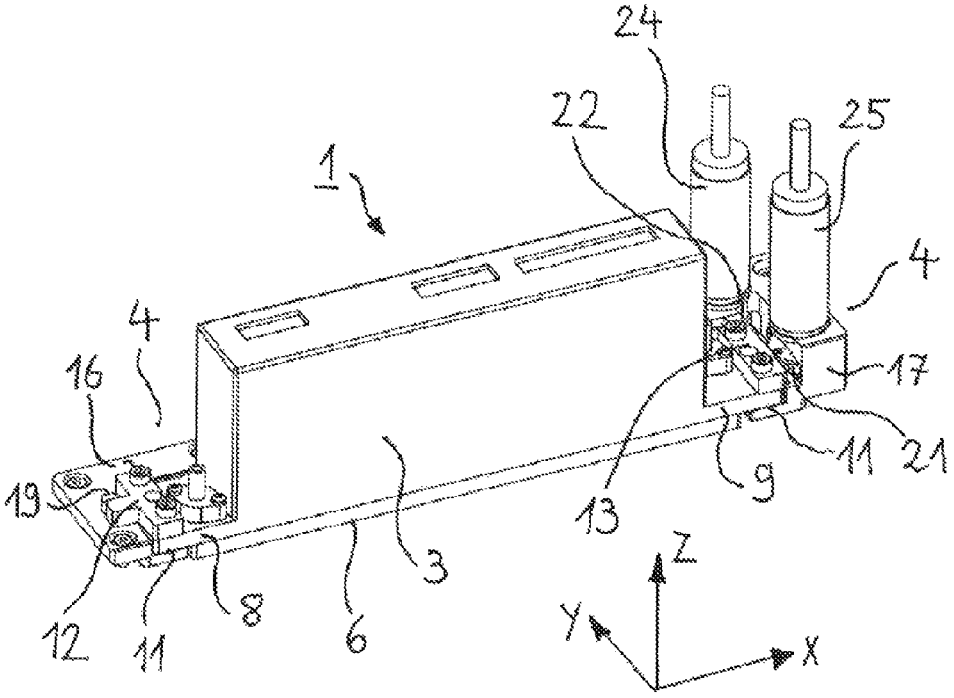
FIG. 2 shows a perspective illustration of a second variant of a print head adjustment device with a print head and an adjustment adapter.

FIG. 2 shows a second variant of a print head adjustment device 1 from a similar perspective to that in FIG. 1. The print head adjustment device 1 in FIG. 2 differs from the print head adjustment device 1 according to FIG. 1 as a result of the configuration of the first contact element 12. The contact element 12 according to FIG. 2 has a substantially T-shaped design, that limb of the T which extends in the X-direction bearing against the pin 19 in the Y-direction. In the X-direction, the contact element 12 is mounted displaceably on the pin 19. Otherwise, the two contact elements 12, 13 have a greater thickness in the Z-direction in comparison with the print head adjustment device 1 according to FIG. 1.

The second contact element 13 which bears against the first eccentric cam 21 in the X-direction and against the second eccentric cam 22 in the Y-direction can be seen clearly at the fixed end 9 of the print head 3. The two eccentric cams 21, 22 are received in a rotatably movable manner in the angled second adapter part 17 of the adjustment adapter 4.

Figure 3:
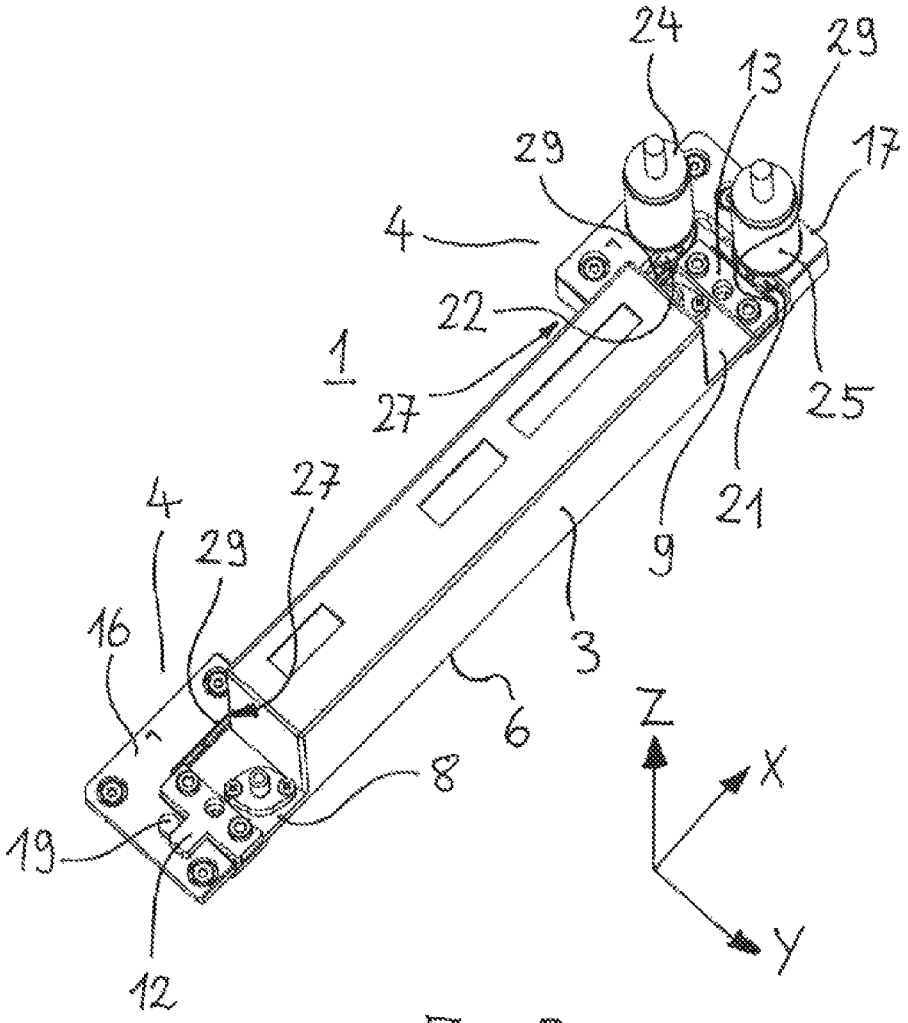
FIG. 3 shows the print head adjustment device according to FIG. 2 from another perspective.

FIG. 3 shows the print head adjustment device 1 according to FIG. 2 in a plan view. The print head 3 can be seen from above in the Z-direction. The fixed end 8 and the loose end 9 of the print head 3 become directly visible. The T-shaped first contact element 12 which bears against the pin 19 of the first adapter part 16 of the adjustment adapter 4 in the Y-direction can be seen at the loose end 8.

In each case one gap 27 is formed in the Y-direction between the adjustment adapter 4, comprising the first adapter part 16 and the second adapter part 17, and the print head 3. There, magnet elements 29 are arranged in each case on the first adapter part 16 and on the second adapter part 17. The magnet elements 29 are configured as permanent magnets and prestress the loose end 8 of the print head 3 against the pin 19 on the first adapter part 16 and prestress the loose end 9 against the second eccentric cam 22 on the second adapter part 17. Furthermore, further magnet elements can be seen on the second adapter part 17, which magnet elements 29 prestress the print head 3 overall or its fixed end 9 against the first eccentric cam 29 in the X-direction.

Additionally used magnet elements which prestress the ends of the print head 3 in the Z-direction downward against the contact faces 11 which can be seen from FIGS. 1 and 2 cannot be seen in FIGS. 1 to 3.

Figure 4:
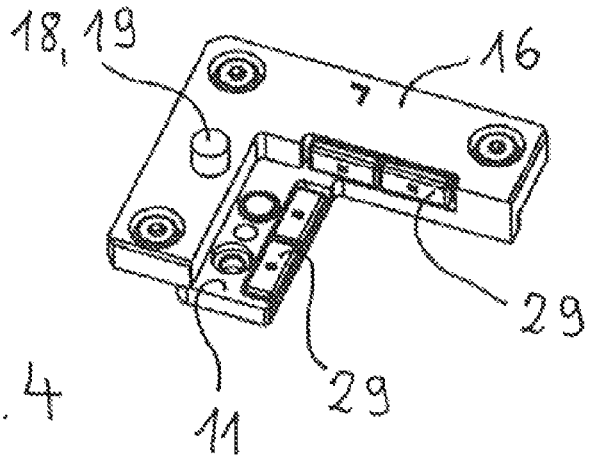
FIG. 4 shows a detailed view of a first adapter part for mounting the loose end of a print head.

FIG. 4 shows a detailed view of the first adapter part of the print head adjustment devices 1 which are shown in FIGS. 1 and 2. The first adapter part 16 mounts the loose end 8 of the print head 3. The pin 19 can be seen clearly, against which a limb of the first contact element 12 bears in the X-direction. The bearing face 11 can likewise be seen, against which the loose end 8 of the print head 3 bears in the Z-direction. The magnet elements 29 which can now be seen clearly are integrated into said contact face 11, which magnet elements 29 pull or prestress the loose end 8 of the print head 3 in the Z-direction against the first adapter part 16 and therefore against its contact face 11.

Figure 5:
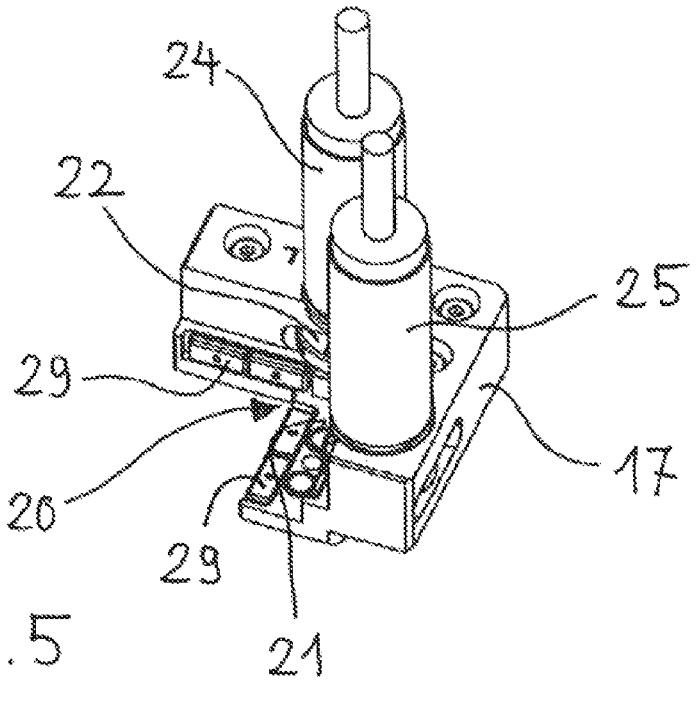
FIG. 5 shows a detailed view of a second adapter part for receiving the fixed end of a print head.

In a further detailed view according to FIG. 4, FIG. 5 shows the second adapter part 17 of the print head adjustment devices 1 according to FIGS. 1 and 2 for adjustably receiving the fixed end 9 of the print head 3. The receiving means 20 which receives the fixed end 9 of the print head 3 can now be seen clearly, which receiving means 20 comprises a first eccentric cam 21 for contact in the X-direction and a second eccentric cam 22 for contact in the Y-direction. The two electric drives 24, 25 for actuating the eccentric cams 22, 21 are arranged in the angled second adapter part 17. The electric drives 24, 25 can be adjusted in an infinitely variable manner by a corresponding control device.

The magnet elements 29 which prestress the fixed end 9 of the print head 3 firstly in the Y-direction against the second eccentric cam 22 and secondly in the Z-direction against the contact face 11 of the second adapter part 17 can also be seen clearly in FIG. 5. The magnet elements 29 which prestress the fixed end 9 of the print head 3 against the first eccentric cam 21 cannot be seen in FIG. 5.

LIST OF DESIGNATIONS

1 Print head adjustment device
3 Print head
4 Adjustment adapter
6 Printing side
8 Loose end
9 Fixed end
11 Contact face
12 First contact element
13 Second contact element
16 First adapter part
17 Second adapter part
18 Stop element
19 Pin
20 Receiving means
21 First eccentric cam
22 Second eccentric cam
24 Drive motor
25 Drive motor
27 Gap
29 Magnet element

The invention claimed is:

1. A print head adjustment device for an inkjet printer comprising a print head module having a frame that receives a plurality of instances of the print head adjustment device, the print head adjustment device comprising:

an adjustment adapter fixedly mountable to the frame of the print head module; and a single print head with a printing side which extends in an X-Y plane, wherein:

the adjustment adapter is configured to receive the single print head;

the adjustment adapter comprises a receiver which can be adjusted in the X-Y plane and in which a fixed end of the print head is received; and a loose end of the print head is mounted on the adjustment adapter such that the loose end of the print head can be displaced in the X-direction and such that the loose end of the print head can be rotated about a rotational axis which is perpendicular with respect to the X-Y plane.

2. The print head adjustment device as claimed in claim 1, the receiver being configured such that the receiver can be adjusted independently in the X-direction and in the Y-direction.

3. The print head adjustment device as claimed in claim 1, the receiver comprising two rotatable eccentric cams which are arranged offset in the X-Y plane and against which the fixed end of the print head bears.

4. The print head adjustment device as claimed in claim 1, the fixed end of the print head being prestressed against the receiver.

5. The print head adjustment device as claimed in claim 4, the fixed end of the print head being prestressed magnetically against the receiver.

6. The print head adjustment device as claimed in claim 1, the adjustment adapter comprising a stop element, against which the loose end of the print head bears in the Y-direction.

7. The print head adjustment device as claimed in claim 6, the stop element being configured as a pin which extends in the Z-direction.

8. The print head adjustment device as claimed in claim 6, the loose end of the print head being prestressed in the Y-direction against the stop element.

9. The print head adjustment device as claimed in claim 8, the loose end of the print head being prestressed magnetically in the Y-direction against the stop element.

10. The print head adjustment device as claimed in claim 1, the adjustment adapter being of a multiple piece configuration.

11. The print head adjustment device as claimed in claim 10, the adjustment adapter being divided into a first adapter part which receives the loose end of the print head and into a second adapter part which receives the fixed end of the print head.

12. The print head adjustment device as claimed in claim 1, the adjustment adapter comprising a contact face for the print head in the Z-direction.

13. The print head adjustment device as claimed in claim 12, the print head being prestressed against the contact face of the adjustment adapter.

14. The print head adjustment device as claimed in claim 13, the print head being prestressed magnetically against the contact face of the adjustment adapter.

15. The print head adjustment device as claimed in claim 1, the adjustment adapter being manufactured substantially from a stretch-free material which, in a temperature range between 20° C. and 50° C., has a coefficient of thermal expansion of less than $5*10^{-6}K^{-1}$.

16. The print head adjustment device as claimed in claim 1, further comprising an electric drive that adjusts the adjustment adapter.

17. The print head adjustment device as claimed in claim 15, the adjustment adapter being manufactured substantially from the stretch-free material which, in a temperature range between 25° C. and 40° C., has a coefficient of thermal expansion of less than $2*10^{-6}K^{-1}$.

18. The print head adjustment device as claimed in claim 1, wherein the adjustment adapter comprises:

a first adapter part that receives the loose end of the print head, wherein:

the first adapter part has a pin stop element (i) against which the loose end of the print head is pressed in the Y-direction and (ii) which defines the rotational axis; and the first adapter part is separated from the loose end of the print head in the X-direction; and a second adapter part that (i) receives the fixed end of the print head and (ii) comprises the receiver, wherein the receiver comprises:

a first eccentric cam against which the fixed end of the print head is pressed in the X-direction;

a second eccentric cam against which the fixed end of the print head is pressed in the X-direction, such that:

when the first eccentric cam rotates, the print head translates in the X-direction; and when the second eccentric cam rotates, the print head rotates about the rotational axis defined by the pin stop element of the first adapter part.

19. The print head adjustment device as claimed in claim 18, wherein the receiver further comprises first and second electric drives that rotate the first and second eccentric cams, respectively.

20. The print head adjustment device as claimed in claim 18, wherein the print head comprises:

a first contact element (i) forming the loose end of the print head and (ii) having an L or T shape that provides (a) a surface against which the pin stop element is pressed in the Y-direction and (b) the separation between the first adapter part and the loose end of the print head in the X-direction; and a second contact element (i) forming the fixed end of the print head and (ii) providing (a) a first surface against which the first eccentric pin is pressed and (b) a second surface orthogonal to the first surface against which the second eccentric pin is pressed.

* * * * *